US007458822B2

(12) United States Patent
Ono

(10) Patent No.: US 7,458,822 B2
(45) Date of Patent: Dec. 2, 2008

(54) ELECTRICAL CONNECTOR AND COMBINATION CONNECTOR HAVING THE SAME

(75) Inventor: Shozo Ono, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/068,982

(22) Filed: Feb. 14, 2008

(65) Prior Publication Data

US 2008/0207010 A1 Aug. 28, 2008

(30) Foreign Application Priority Data

Feb. 26, 2007 (JP) ..... 2007-045287

(51) Int. Cl.
*H01R 12/00* (2006.01)

(52) U.S. Cl. ..... 439/74; 439/570

(58) Field of Classification Search ..... 439/74, 439/660, 563, 569, 570
See application file for complete search history.

(56) References Cited

U.S. PATENT DOCUMENTS 6,471,539 B1 * 10/2002 Yu ..... 439/489

FOREIGN PATENT DOCUMENTS

JP 3119722 U 2/2006

* cited by examiner

*Primary Examiner*—Tho D Ta
(74) *Attorney, Agent, or Firm*—Kubotera & Associates, LLC

(57) ABSTRACT

An electrical connector includes a housing having a first sidewall surface and a second sidewall surface extending in a first direction in parallel to each other with a first distance therebetween; a first terminal having a first contact portion protruding from the first sidewall surface in a second direction substantially perpendicular to the first direction; a second terminal having a second contact portion protruding from the second sidewall surface; and an extension portion having a first external wall surface and a second external wall surface. The extension portion is arranged so that a center point between the first external wall surface and the second external wall surface is shifted with respect to a center point between the first contact portion and the second contact portion. The first external wall surface extends in parallel to the second external wall surface with a second distance larger than the first distance.

10 Claims, 6 Drawing Sheets

ELECTRICAL CONNECTOR AND COMBINATION CONNECTOR HAVING THE SAME

BACKGROUND OF THE INVENTION AND RELATED ART STATEMENT

The present invention relates to an electrical connector to be attached to a circuit board and a combination connector having the electrical connector.

Patent Reference has disclosed a connector, in which contact portions of terminals are arranged on both sidewall surfaces of a housing that extends laterally on a circuit board. Such a connector is, in many cases, required to be small. Accordingly, in the connector, a dimension between the both sidewall surfaces is required to be small as well as dimensions thereof in a terminal arrangement direction; that is, a longitudinal direction thereof, and in a height direction thereof.

Patent Reference: Japanese Patent Publication No. 3119722

In the connector disclosed in Patent Reference, the contact portions of the terminals are arranged on the both sidewall surfaces of the housing. Further, the connector is attached to the circuit board as a male connector. In the male connector, metal fittings as grounding members are attached to edge wall surfaces of both ends of the housing in the longitudinal direction. The metal fittings are bent in an L-shape from the edge wall surfaces, so that surface portions thereof contact with the circuit board. Thus, the male connector is fixed to the circuit board at the surface contacts.

A female connector is fitted into the male connector. The female connector or a mating connector is provided with a fitting recess portion. In the female connector, contact portions of terminals are arranged on an inner surface of the fitting recess portion. Further, the contact portions of the terminals contact with and are connected to the contact portions of the male connector. In the female connector, a cable is wired to each terminal. The cable is drawn in a direction parallel to the circuit board and perpendicular to one of the sidewall surfaces.

After the female connector is attached to the male connector, the female connector often receives an inadvertent external force at a drawn base portion of the cable that is drawn from the female connector in one direction.

In general, female and male connectors are provided with locking portions, so that after fitting the female and male connectors are not disconnected upon receiving an inadvertent external force. In the connector disclosed in Patent Reference, a locking portion may be provided in, for example, anywhere on a circumference of the housing of the male connector that is attached to the circuit board.

In the male connector disclosed in Patent Reference, when the drawn base portion of the cable of the female connector receives an inadvertent external force, the male connector receives a moment around an axial line that extends in a longitudinal direction thereof on the both sidewall surfaces thereof.

When the locking portions are provided on the both sidewall surfaces of the housing, it is necessary to support the moment over a distance between the both sidewall surfaces with an opposing moment generating a couple force of a product of an arm length and a reaction force at the locking portions, thereby reinforcing the housing at the both sidewall surfaces. Accordingly, when the arm length becomes larger, it is possible to reinforce the housing to a greater extent.

As described above, it is necessary to reduce a size of the connector in every direction. Accordingly, it is difficult to increase the arm length. When the arm length increases, it is necessary to increase a distance between at least the both sidewall surfaces where the locking portions are disposed, thereby increasing a size of the connector. When the connector is arranged on the circuit board, a surrounding area thereof may not be available.

In view of the problems described above, an object of the present invention is to provide an electrical connector for a circuit board, in which it is possible to reduce a size thereof while sufficiently securing an opposing moment force functioning as a locking mechanism against an external force.

Further objects of the invention will be apparent from the following description of the invention.

SUMMARY OF THE INVENTION

In order to attain objects described above, according to the present invention, an electrical connector is mounted on a circuit board. The electrical connector has two sidewall surfaces. The two sidewall surfaces rise from an attachment face of a housing and are parallel to each other. Further, the two sidewall surfaces extend in an arrangement direction of terminals and face each other. In addition, the housing has a surface contacting the circuit board.

The terminals have contact portions that protrude from the sidewall surfaces in a facing direction of the two sidewall surfaces, respectively. The contact portion contacts with a terminal of a mating connector. Further, the housing or a member attached to the housing forms an extension portion that extends outside of a terminal arrangement range in a terminal arrangement direction.

In the electrical connector for a circuit board according to the present invention, the extension portion is provided with two external wall surfaces extending in parallel to the two sidewall surfaces and face each other. A distance between the external wall surfaces in the facing direction is set to be larger than a distance between the two sidewall surfaces.

It is characterized that a terminal center position and an extension portion center position are shifted with each other in the facing direction. The terminal center position is a center of a distance between the contact portions that protrude from the two sidewall surfaces in opposite directions. The extension portion center is a center of a distance between the two external wall surfaces of the extension portion.

In the present invention, the extension portion that is provided in the housing or is the member attached to the housing protrudes outside of a terminal arrangement range with respect to only one of the sidewall surfaces in the facing direction of the both sidewall surfaces of the housing in a range in which the terminals are arranged. The cable is derived on one of the sidewall sides of the female connector that is the mating connector to be fitted into the electrical connector, so that an area on the circuit board in the direction is not used.

Accordingly, when the extension portion is positioned in the area, even though the extension portion protrudes to one of the sidewall sides, the extension portion only protrudes to the unused area, thereby not inhibiting reduction in a size of the electrical connector.

In addition, through increasing the distance between the two external wall surfaces of the extension portion, an opposing moment is obtained with respect to a moment generated through an external force received in the cable derivation base portion of the mating connector in a state that the electrical connector is fitted with the mating connector on the sidewall surfaces and the external wall surfaces. Accordingly, the opposing moment becomes large doe to the large distance, thereby securing a locking mechanism.

In the present invention, it is preferred that the extension portion center position is positioned between the contact portions. Accordingly, the extension portion does not protrude in an large amount with respect to the wall surface in a shift direction that is generated by a shift amount of the extension portion center position with respect to the terminal center position.

In the present invention, the external wall surfaces of the extension portion can be formed of surfaces of a metal fitting that is attached to the housing. The metal fitting has a higher strength than a resin. Accordingly, the metal fitting can adequately support a moment and is resistant to damage on a surface thereof, even though a large moment is received from the mating connector. Further, the metal fitting can be provided with grounding property as a grounding member or an attachment function to the circuit board as a reinforcing member. Accordingly, the metal fitting increases utility.

In the present invention, one of the two external wall surfaces provided in the extension portion is preferred to be at a position substantially the same as that of one of the sidewall surfaces in the facing direction of the two sidewall surfaces.

When one of the external wall surfaces that is positioned at the position substantially the same as that of one of the sidewall surface is arranged on the circuit board to position on a opposite side of the cable derived from the mating connector, the extension portion does not protrude from the position of the sidewall surface on the side in which the cable does not exist. Thus, a larger active area on the circuit board is secured. That is, the extension portion center position is shifted with respect to the terminal center position in the extending direction of the cable on the side of one of the sidewall surfaces of the mating connector.

In the present invention, the terminal may have a first terminal and a second terminal. A contact portion of the first terminal protrudes from one of the sidewall surfaces, while a contact portion of the second terminal protrudes from the other sidewall surface. Further, the first terminal and the second terminal can be arranged alternately.

In the present invention, the terminal may have the connection portion for connection with the circuit board protruding from the sidewall surface that face the sidewall surface from which the contact portion protrudes.

In the present invention, the electrical connector may fitted with the mating connector to form a combination connector. Further, the cable that is wired to the mating connector can be derived to the shift direction of the extension portion center position with respect to the terminal center position on one of the sidewall surface sides.

In the present invention, as described above, the electrical connector has the extension portions that extend outside the terminal arrangement range. In the electrical connector, the contact portions of the terminals are arranged on the both sidewall surfaces that extend in the longitudinal direction of the housing.

The distance between the both external wall surfaces of the extension portion is made larger than the distance between the both sidewall surfaces in the facing direction of the both sidewall surfaces. Further, the extension portion center position, i.e., the center of the distance between the both external wall surfaceso is shifted with respect to the terminal center position, i.e., the center of the distance between the contact portions on the both sidewall surfaces.

Accordingly, when the cable is derived from the mating female connector in the shift direction, the area that is utilized for other purposes due to a position of the cable can be utilized for the shift portion of the extension portion. Accordingly, a distance between the extension portions can be ensured to be large without enlarging the electrical connector. Thus, the enough opposing moment is obtained on the two external wall surfaces with respect to the moment received from the mating connector due to an inadvertent external force.

DETAILED DESCRIPTION OF PREFERRED EMBODIMENTS

Hereunder, embodiments of the present invention will be explained with reference to the accompanying drawings.

Figure 1:
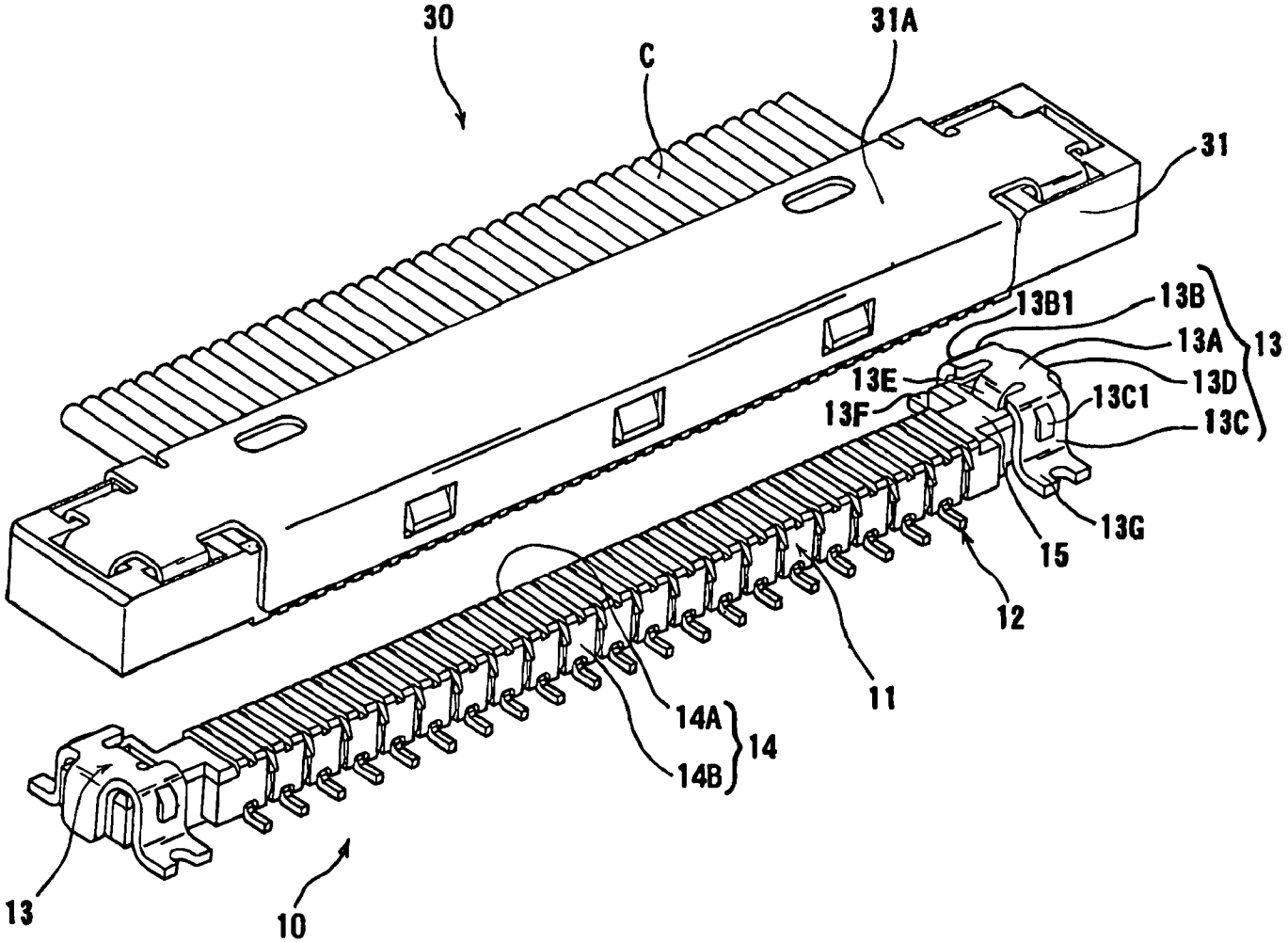
FIG. 1 is a perspective view showing a male connector and a female connector before the female connector is fitted into the male connector according to an embodiment of the present invention.
Figure 2:
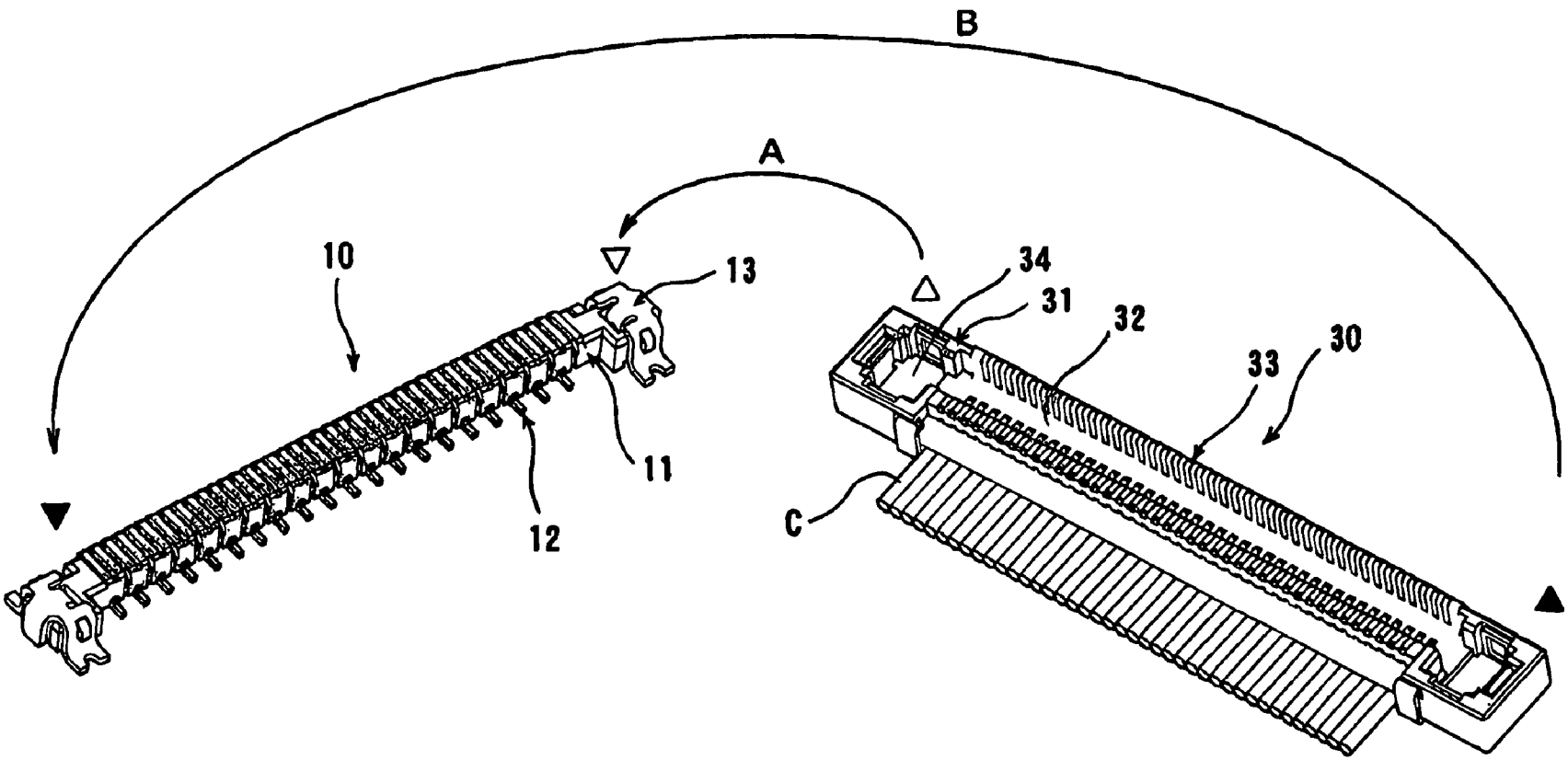
FIG. 2 is a perspective view of the connector and the female connector having a fitting side that is inversed to be positioned on an upper side according to the embodiment of the present invention.

FIG. 1 is a perspective view showing a male connector 10 and a female connector 30 before the female connector 30 is fitted into the male connector 10 according to an embodiment of the present invention. FIG. 2 is a perspective view of the connector 10 and the female connector 30 having a fitting side that is inversed to be positioned on an upper side.

As shown in FIG. 2, the male connector 10 is fitted into the female connector 30 at fitting portions thereof. Accordingly, one of the fitting portions of the male connector 10 and the female connector 30 are indicated by Δ and ∇, while the other of the fitting portions of the male connector 10 and the female connector 30 are indicated by ▲ and ▼, respectively.

In the embodiment, the male connector 10 and the female connector 30 are fitted into each other from Δ to ∇ and ▲ to ▼ as indicated by arrows A and B, respectively. FIGS. 3(A) and 3(B) are enlarged perspective views of the Δ and ∇ portions of the male connector 10 and the female connector 30, respectively.

The male connector 10 is arranged on a circuit board (not shown) and electrically connected with the circuit board. In the male connector 10, a plurality of terminals 12 is arranged in a housing 11. The housing 11 is arranged and extends on the circuit board. Further, metal fittings 13 are provided on both edges of the male connector 10 in a longitudinal direction thereof.

The housing 11 is made of an electrical insulation member such as a resin. Further, the housing 11 has two sidewall surfaces 14 (14A and 14B). The wall surfaces 14 (14A and 14B) rise from an attaching face (bottom surface) of the housing 11 arranged on the circuit board and extend toward the longitudinal direction. Further, the wall surfaces 14 (14A and 14B) are parallel to and face each other.

In the embodiment, in a range in which the sidewall surfaces 14 are provided in the longitudinal direction, the plurality of the terminals 12 is arranged and held through the housing 11. The housing 11 has a metal fitting attaching portion 15 on each of the sides outside of the range in which the sidewall surfaces 14 are provided in the longitudinal direction. The metal fitting 13 is attached to each of the metal fitting attaching portions 15.

Figure 4:
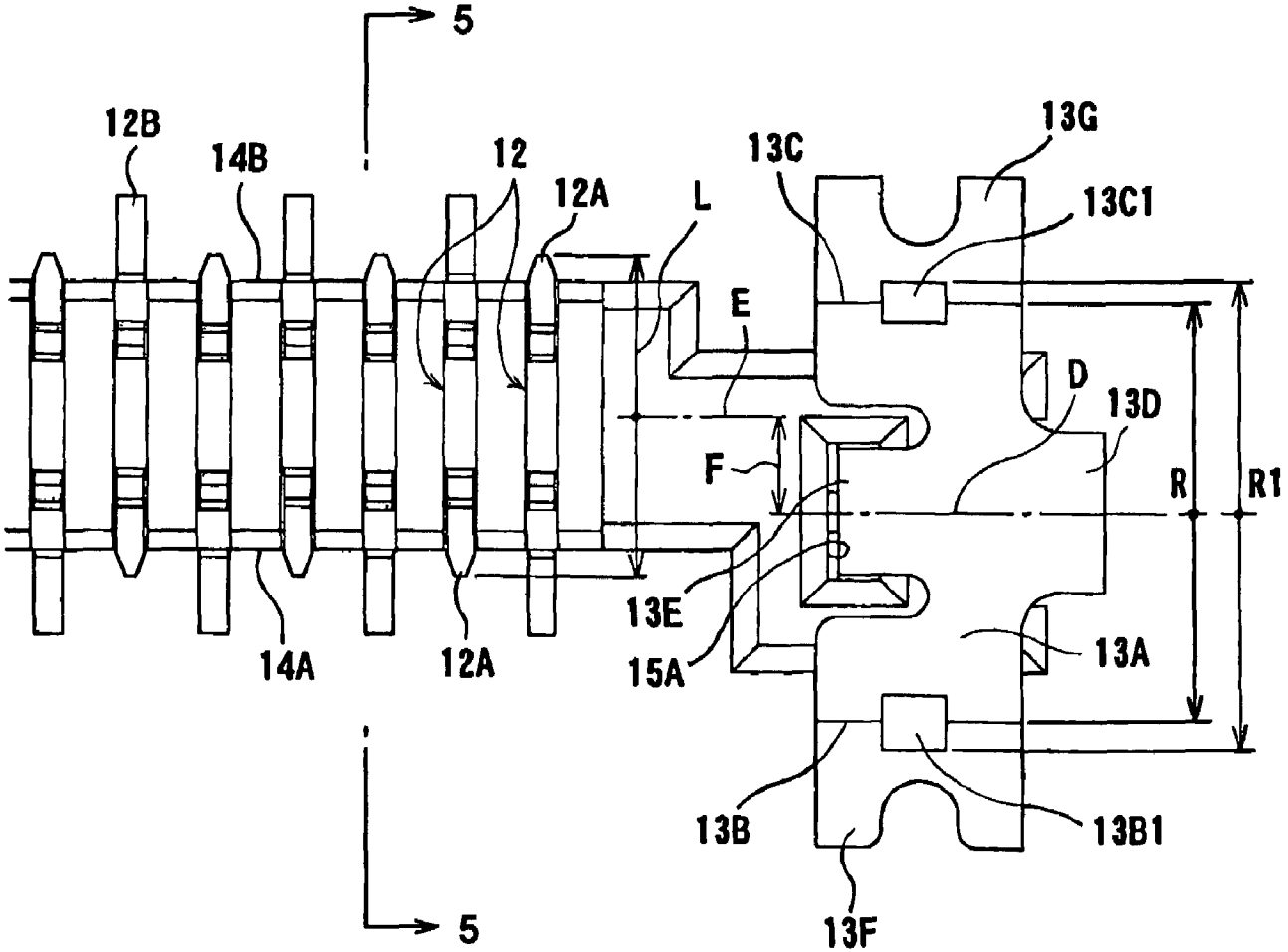
FIG. 4 is a plan view of the male connector viewed from above according to the embodiment of the present invention.

As shown in FIG. 4, in the metal fitting attaching portions 15, an axis line D is shifted from an axis line E by a distance F. The axis line D passes through a center position (extension portion center position) of the metal fitting attaching portions 15 in a facing direction of the sidewall surfaces 14A and 14B. The axis line E passes through a center position (terminal center position) in the same direction of the two sidewall surfaces 14A and 14B of the housing 11.

The axis line E is provided at the center position in the facing direction of the two sidewall surfaces 14A and 14B. Each of the contact portions 12A of the terminals 12 protrudes from the both sidewall surfaces 14A and 14B by a same protrusion amount. Accordingly, the axis line E is also at a center position of a distance L. The distance L is a distance between the ends of the contact portions 12A. The metal fitting attaching portion 15 and the metal fitting 13 will be explained later.

The terminal 12 is made of a metal sheet while maintaining a flat surface of the metal sheet. FIG. 4 is a plan view of a part of the male connector 10 shown in FIG. 1. As shown in FIG. 4, the contact portions 12A of the adjacent terminals 12 are arranged to protrude alternately from the sidewall surfaces 14A and 14B.

In the embodiment, the terminals 12 have connection portions 12B extending from the sidewall surfaces 14A and 14B opposite to the sidewall surfaces 14A and 14B the contact portions 12A protruding.

Figure 5:
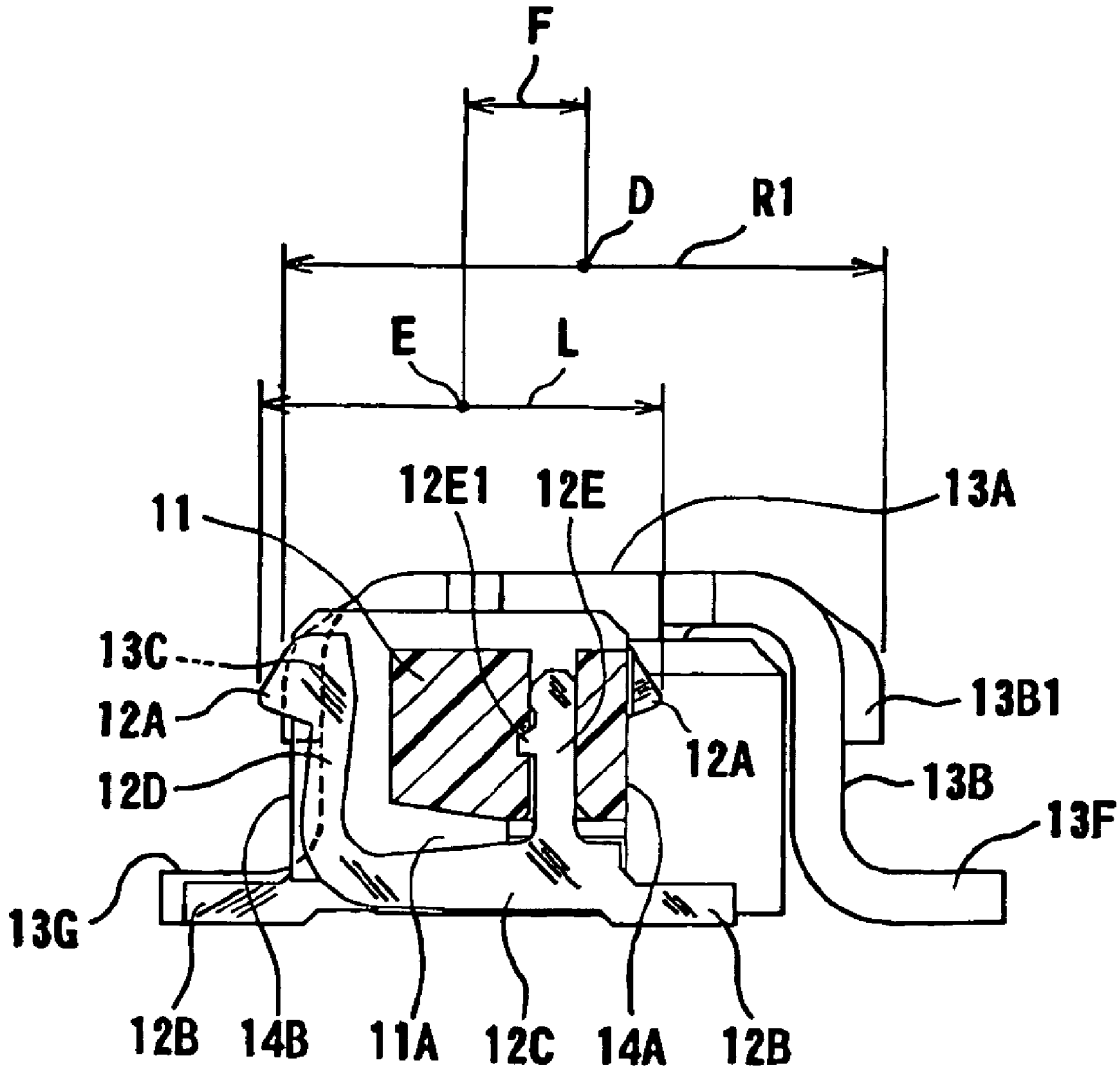
FIG. 5 is a sectional view of the male connector taken along a line 5-5 in FIG. 4 according to the embodiment of the present invention.

FIG. 5 is a sectional view of the male connector 10 taken along a line 5-5 in FIG. 4. As shown in FIG. 5, the terminal 12 has an elastic arm 12D, a fixed arm 12E, and the connection portion 12B. The elastic arm 12D rises from one end portion of a base portion 12C having a horizontally long shape. The base portion 12C is accommodated in a bottom groove 11A of the housing. The fixed arm 12E rises from a middle portion of the base portion 12C. The connection portion 12B extends outwardly from the other end of the base portion 12C to an outside of the housing 11.

The elastic arm 12D is accommodated in one of the sidewall surfaces of the housing; that is, a groove formed in the sidewall surface 14B in an example of the terminal shown in FIG. 5. The elastic arm 12D has the contact portion 12A protruding from the sidewall surface 14B on a distal thereof. The fixed arm 12E has a protrusion 12E-1 on a side edge thereof. The fixed arm 12E bites into the housing 11 to prevent the terminal 12 from coming off. The connection portion 12B is situated outside of the housing 11 and positioned so that a bottom edge thereof is adjacent to a surface of the circuit board. Further, the connection portion 12B is connected with a corresponding circuit portion of the circuit board with solder.

As shown in FIG. 1, a plurality of the terminals 12 is arranged. The contact portions 12A and the connection portions 12B of the terminals 12 that are adjacent to each other are positioned oppositely oriented to each other in the arrangement direction. That is, when the contact portion 12A of one of the terminals 12 protrudes from the sidewall surface 14B to a left side and the connection portion 12B protrudes from the sidewall surface 14A to a right side, the contact portion 12A of the terminal 12 that is adjacent to the one of the terminals 12 protrudes from the sidewall surface 14A to the right side, and the connection portion 12B thereof protrudes from the sidewall surface 14B to the left side.

As shown in FIG. 4, the metal attaching portions 15 provided on both ends of the housing 11 in the longitudinal direction thereof is shifted toward the sidewall surface 14A in a facing direction of the two sidewall surfaces 14A and 14B over a range in which the sidewall surfaces 14A and 14B are provided. The sidewall surfaces 14A and 14B of the housing 11 face each other. The shift will be explained below in relation to the terminals 12 and the metal fitting 13.

As shown in FIG. 1, the metal fitting 13 attached to the metal fitting attaching portion 15 is formed through processing a metal sheet. Further, the metal fitting 13 has a top wall portion 13A, sidewall portions or external wall surfaces 13B and 13C, and an edge wall portion 13D to cover the metal fitting attaching portion 15. An attachment piece 13E is bent to extend downwardly (a back direction of a sheet in FIG. 4) from the top wall portion 13A. The attachment piece 13E is pressed into an attachment hole 15A provided in the metal fitting attaching portion 15. Attachment legs 13F and 13G extend in an L-shape on bottom edges of the sidewall portions 13B and 13C, respectively.

The metal fitting 13 described above is provided with lock protrusion portions 13B1 and 13C1 at borders between the top wall portion 13A and the sidewall portions 13B and 13C, respectively. The lock protrusion portions 13B1 and 13C1 extend toward the attachment legs 13F and 13G, respectively. The lock protrusion portions 13B1 and 13C1 are formed of partial cut portions of the metal fitting 13 punched from an inside surface side thereof. Top edges of the lock protrusion portions 13B1 and 13C1 form inclined portions and bottom edges thereof have step shapes, so that a mating connector can be easily guided with the inclined portions and locked to engage with the bottom edges having the step shapes.

The attachment piece 13E of the metal fitting 13 is pressed into the attachment hole 15A of the housing 11. Accordingly, the metal fitting 13 covers the metal fitting attaching portion 15 of the housing 11 and is fixed to the metal fitting attaching portion 15.

In the embodiment, the metal fitting 13 attached to the metal fitting attaching portion 15 of the housing 11 forms an extension portion coupled with the metal fitting attaching portion 15. The extend portion extends from a range of the sidewall surfaces 14A and 14B of the housing 11; that is, from a terminal arrangement range to an outside of the range thereof.

Accordingly, the sidewall portions 13B and 13C of the metal fitting 13 form external wall surfaces of the extension portion. The external wall surfaces become fitting surfaces with respect to the mating connector.

When the mating connector has a cable that extends in a facing direction of the sidewall surfaces 14A and 14B and an external force to lift a wire base portion of the cable is applied, a reaction force to oppose a moment produced by the external force is generated on the two external wall surfaces. A product of the reaction force and a distance R is an opposing moment. The distance R is a distance between the external wall surfaces shown in FIG. 4.

In the embodiment, the sidewall portions 13B and 13C, i.e., the external wall surfaces, are provided with the lock protrusion portions 13B1 and 13C1, respectively. Further, most of the reaction force is generated in the lock protrusion portions 13B1 and 13C1. Accordingly, an arm length that multiplies the reaction force to obtain the opposing moment is to be, to be precise, the distance R1 between the lock protrusion portions 13B1 and 13C1. However, the distances R and R1 are approximate. Both of center positions of the distance R and the distance R1 are on the axis line D of the metal attaching portion 15.

The axis line D at the metal fitting attaching portion 15 of the housing 11 is shifted by the distance F from the axis line E. Accordingly, the center positions of the distance R and the distance R1 are also shifted by the distance F from the axis line E.

In the embodiment, the axis line D is positioned in a range of the distance L between the two sidewall surfaces 14A and 14B of the housing 11. Further, the sidewall portion 13C of the metal fitting 13 on a side of the sidewall surface 14B is situated at a position substantially the same as that of the sidewall surface 14B in the facing direction of the sidewall surfaces 14A and 14B.

As described above, the female connector 30 is fitted into the male connector 10. As shown in FIG. 1, in the female connector 30, a shield case 31A is attached to the housing 31 that holds the terminals. Further, a plurality of cables C wired to the terminals is derived sideway.

Figure 3:
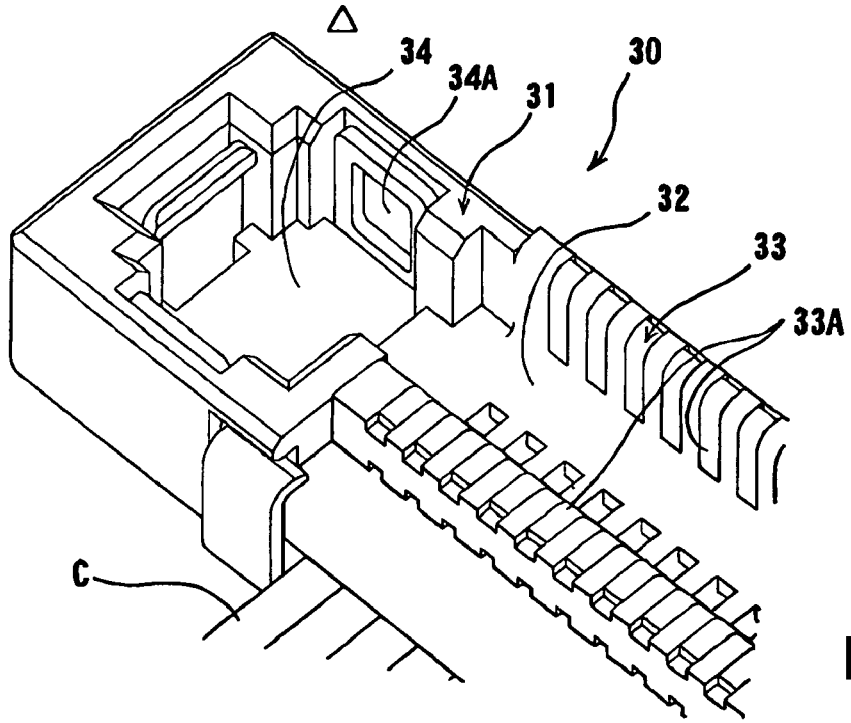
FIGS. 3(A) and 3(B) are enlarged perspective views showing the male connector and the female connector, respectively, according to the embodiment of the present invention.
Figure 3:
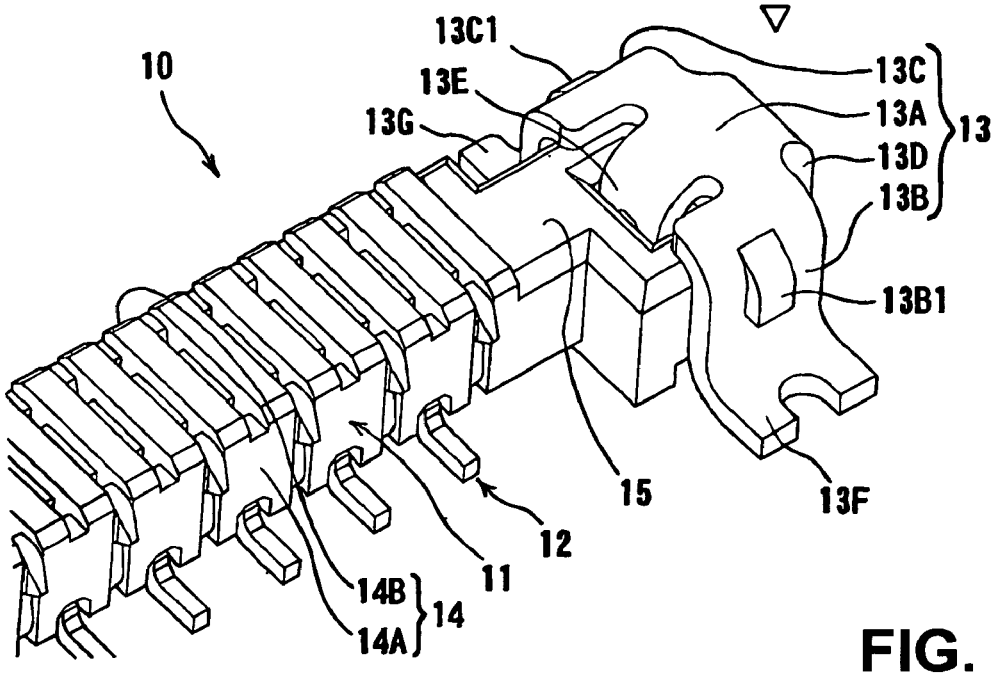

As shown in FIGS. 2 and 3, in the female connector 30, a fitting recess portion 32 is provided in the housing 31 on a fitting side with the male connector 10. Contact portions 33A of terminals 33 are arranged on inner surfaces of the fitting recess portion 32 that face each other. The contact portions 33A of terminals 33 correspond to the contact portions 12A of the terminals 12 of the male connector 10.

Further, extension portion fit-in recessed portions 34 are provided on both ends of the housing 31 outside of the arrangement range thereof. The extension portion fit-in recessed portions 34 are shifted with respect to the range in which the terminals 33 are arranged by a distance the same as the distance F in the male connector 10 to correspond to the male connector 10. As shown in FIGS. 2 and 3, a direction of the shift is the direction that the cables C extend from the female connector 30.

In the embodiment, locking engagement portions 34A are provided on opposing inner wall surfaces of the extension portion fit-in recessed portions 34. The locking engagement portion 34A is a stepped recess portion to engage the lock protrusion portion 13C1 of the metal fitting 13 of the male connector 10. A bottom edge step portion of the lock protrusion portion 13C1 engages with a stepped edge portion of the locking engagement portion 34A to lock with each other.

The male connector 10 and the female connector 30 are used as follows.

First, the male connector 10 is situated with respect to a mounting object such as the circuit board and the like, so that the connection portions 12B of the terminals 10 are positioned on the corresponding circuit portion and the attachment legs 13F and 13G of the metal fitting 13 are positioned on the corresponding attaching portions. Then, the connection portions 12B are connected with solder and the like, and the attachment legs 13F and 13G are fixed to the mounting object.

As described above, the cables C are wired to the terminals 33 of the female connector 30, and are derived from one of the sidewall surfaces.

Figure 6:
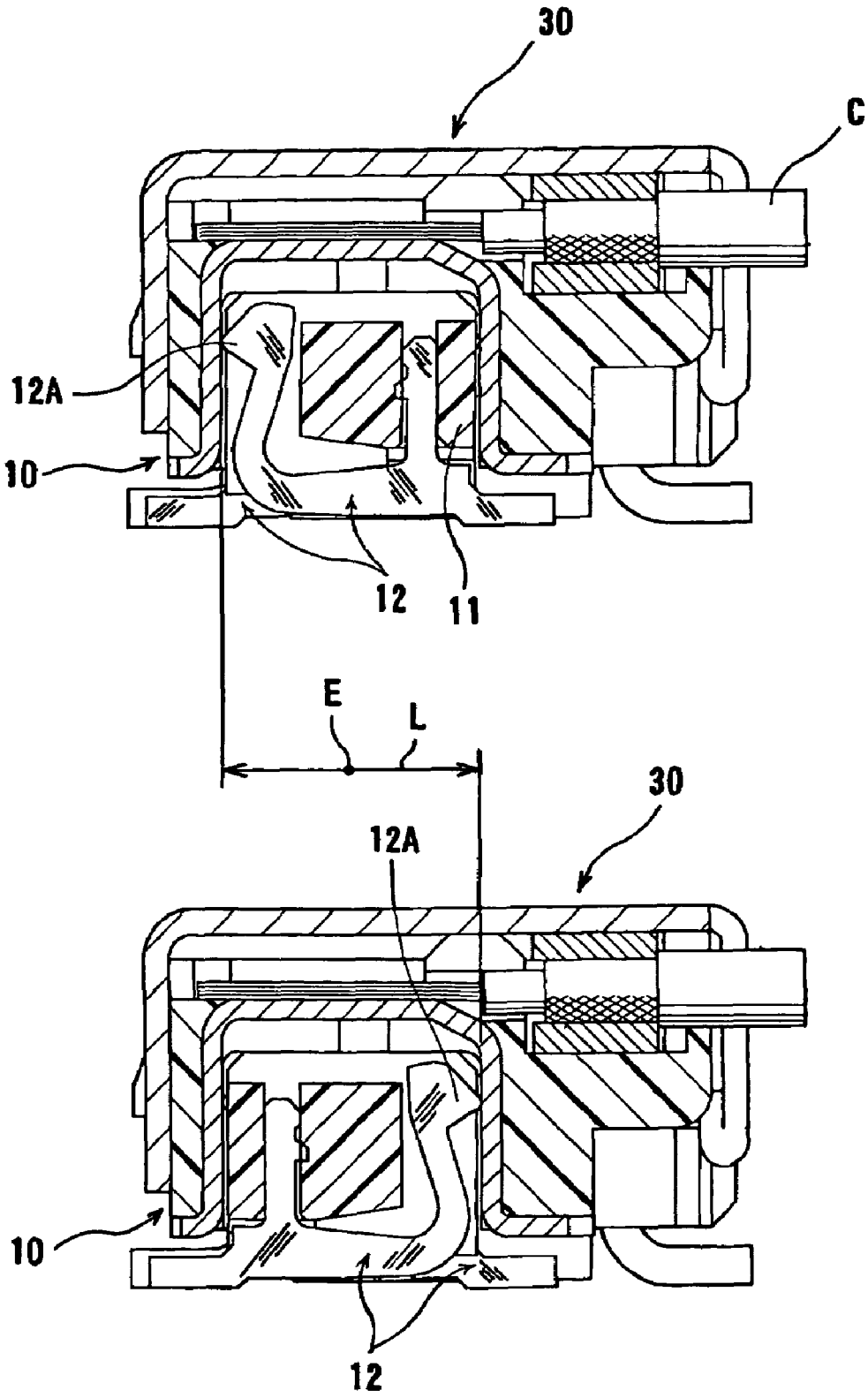
FIG. 6 is sectional views of the male connector and the female connector in a fitted state at positions of different terminals according to the embodiment of the present invention.

After the female connector 30 wired to the cables is prepared with respect to the male connector 10 attached to the mounting object as shown in FIG. 2. The one end portion side Δ and the other end portion side ▲ of the female connector 30 are positioned to correspond to the one end portion side ∇ and the other end portion side ▼ of the male connector 10 in directions indicated by A and B, respectively, while flipping vertically. Accordingly, the female connector 30 is fitted into the male connector 10 (shown in FIG. 6).

After the female connector 30 and the male connector 10 are fitted with each other, the contact portions of the female connector 30 and the male connector 10, respectively, contact each other and are electrically connected. Further, the lock protrusion portions 13C1 of the male connector 10 are locked in the locking engagement portions 34A of the male connector 30.

When an inadvertent external force, for example, an upward force, is applied to derivation base portions of the cables C, a moment is generated in the female connector 30 to pull the female connector 30 off. The cables C are derived from the female connector 30 that is fitted into the male connector 10.

In the embodiment, there is an enough distance between the lock protrusion portions 13B1 and 13C1, that is, a distance between the locking engagement portions 34A, without enlarging the female connector 30 and the male connector 10. Accordingly, the enough opposing moment can be obtained and the female connector 30 is prevented from coming off.

The present invention is not limited to the embodiment described above, and can be modified. For example, in the embodiment described above, the male connector has the lock protrusion portion, and the female connector has the locking engagement portion. These features are not specifically required in the present invention.

Even though the connector does not have the lock protrusion portion and the like, and the external wall surfaces of the extension portion of the male connector are flat surfaces, when the external wall surfaces closely contact or fit at a minimum interval with the corresponding inner wall surfaces of the female connector, the connector can oppose to a moment due to an inadvertent force that applies to the cable derivation base portion of the female connector.

Further, the external wall surface of the extension portion does not have to be the metal fitting, and may be an external surface of the housing. Further, the lock protrusion portion may be formed as a part of the housing.

The disclosure of Japanese Patent Application No. 2007-045287, filed on Feb. 26, 2007, is incorporated in the application by reference.

While the invention has been explained with reference to the specific embodiments of the invention, the explanation is illustrative and the invention is limited only by the appended claims.

What is claimed is:

1. An electrical connector to be attached to a circuit board, comprising:

a housing having a first sidewall surface and a second sidewall surface, said first sidewall surface extending in a first direction in parallel to the second sidewall surface with a first distance therebetween;

a first terminal disposed on the housing, said first terminal having a first contact portion protruding from the first sidewall surface in a second direction substantially perpendicular to the first direction;

a second terminal disposed on the housing, said second terminal having a second contact portion protruding from the second sidewall surface in the second direction; and an extension portion having a first external wall surface and a second external wall surface, said extension portion being arranged so that a center point between the first external wall surface and the second external wall surface in the second direction is shifted with respect to a center point between the first contact portion and the second contact portion in the second direction, said first external wall surface extending in the first direction in parallel to the second external wall surface with a second distance therebetween larger than the first distance.

2. The electrical connector according to claim 1, wherein said extension portion is arranged so that the center point between the first external wall surface and the second external wall surface is situated between the first contact portion and the second contact portion along the second direction.

3. The electrical connector according to claim 1, wherein said extension portion is formed of a metal member attached to the housing, said first external wall surface and said second external wall surface being external wall surfaces of the metal member.

4. The electrical connector according to claim 1, wherein said extension portion includes at lease one of the first external wall surface and the second external wall surface being situated at a position along the second direction same as that of one of the first sidewall surface and the second sidewall surface.

5. The electrical connector according to claim 1, wherein said extension portion is arranged so that the center point between the first external wall surface and the second external wall surface is shifted with respect to the center point between the first contact portion and the second contact portion along a direction that a cable of a mating connector extends.

6. The electrical connector according to claim 1, wherein said first terminal and said second terminal are arranged at a plurality of positions alternately along the first direction.

7. The electrical connector according to claim 1, wherein said first terminal further includes a first connection portion to be connected to the circuit board, said first connection portion protruding from the second sidewall surface.

8. The electrical connector according to claim 1, wherein said second terminal further includes a second connection portion to be connected to the circuit board, said second connection portion protruding from the first sidewall surface.

9. The electrical connector according to claim 1, wherein said extension portion is arranged at each of two end portions of the housing in the first direction.

10. A combination connector comprising the electrical connector according to claim 1, and a mating connector fitted to the electrical connector, said mating connector being connected to a cable extending in the second direction.

* * * * *